US008714146B2

(12) United States Patent
Hu

(10) Patent No.: US 8,714,146 B2
(45) Date of Patent: May 6, 2014

(54) BALLISTIC ADJUSTMENT DEVICE FOR TOY GUN

(76) Inventor: Shih-Che Hu, Tainan (TW)

( * ) Notice: Subject to any disclaimer, the term of this patent is extended or adjusted under 35 U.S.C. 154(b) by 460 days.

(21) Appl. No.: 13/182,443

(22) Filed: Jul. 13, 2011

(65) Prior Publication Data

US 2012/0272941 A1 Nov. 1, 2012

(30) Foreign Application Priority Data

Apr. 28, 2011 (TW) ..... 100114836 A

(51) Int. Cl.
*F41B 11/00* (2013.01)
*F41A 21/10* (2006.01)
*F41B 11/89* (2013.01)

(52) U.S. Cl.
CPC ..... *F41B 11/00* (2013.01); *F41B 11/89* (2013.01); *F41A 21/10* (2013.01)
USPC ..... 124/84; 124/83; 124/85; 42/76.01

(58) Field of Classification Search
CPC ..... F41B 11/00; F41B 11/89; F41A 21/10
USPC ..... 124/83, 84, 85; 42/76.01
See application file for complete search history.

(56) References Cited

U.S. PATENT DOCUMENTS 2,182,369 A * 12/1939 Barron ..... 124/81
3,662,729 A * 5/1972 Henderson ..... 124/73
3,756,001 A * 9/1973 Macidull ..... 56/328.1
3,765,396 A * 10/1973 Kienholz et al. ..... 124/65
3,897,061 A * 7/1975 Grattan ..... 473/511
4,674,470 A * 6/1987 Tsukiji ..... 124/74
4,688,539 A * 8/1987 Lawrence ..... 124/27
5,113,842 A * 5/1992 Moormann ..... 124/65
5,349,938 A * 9/1994 Farrell ..... 124/73
5,450,838 A * 9/1995 Nakahigashi et al. ..... 124/56
5,515,838 A * 5/1996 Anderson ..... 124/76
5,655,510 A * 8/1997 Kunimoto ..... 124/81
5,988,153 A * 11/1999 Yoshimura ..... 124/81
6,273,080 B1 * 8/2001 Sullivan, Jr. ..... 124/84
6,295,752 B1 * 10/2001 Havlock ..... 42/76.01
6,494,195 B2 * 12/2002 Perry et al. ..... 124/84
6,698,128 B2 * 3/2004 Kessler ..... 42/76.01
6,823,857 B2 * 11/2004 Perry et al. ..... 124/84
6,857,423 B2 * 2/2005 Jong ..... 124/79
7,076,905 B2 * 7/2006 Zouboulakis ..... 42/76.01
7,603,998 B2 * 10/2009 Finstad ..... 124/81
7,628,149 B1 * 12/2009 Zarecky et al. ..... 124/85
7,686,003 B2 * 3/2010 Witzigreuter ..... 124/65

(Continued)

*Primary Examiner* — Gene Kim
*Assistant Examiner* — Alexander Niconovich
(74) *Attorney, Agent, or Firm* — Raymond Y. Chan; David and Raymond Patent Firm

(57) ABSTRACT

A ballistic adjustment device installed in a rear end of a gun barrel of a toy gun for adjustment of the ballistic range is disclosed to include a barrel bullet attached to the rear end of the gun barrel and having two inside protruding portions for holding a bullet in balance in the rear end of the gun barrel for firing, a positioning member press-fitted onto the bullet barrel and fastened to the rear end of the gun barrel, a pressure member fastened to the gun barrel and having a spring arm partially and downwardly projecting through an opening on the positioning member into tangent contact with the bullet to be fired, and a rotary control member rotatable to adjust the pressure between the spring arm and the bullet to be fired.

5 Claims, 14 Drawing Sheets

(56) References Cited

U.S. PATENT DOCUMENTS

| | | | | |
|---|---|---|---|---|
| 7,691,759 | B2 * | 4/2010 | Perry et al. | 442/77 |
| 7,980,238 | B2 * | 7/2011 | Wood | 124/84 |
| 8,037,877 | B2 * | 10/2011 | Liao | 124/44.7 |
| 8,397,706 | B2 * | 3/2013 | Wood | 124/84 |
| 8,418,682 | B2 * | 4/2013 | Halmone | 124/84 |
| 2001/0050077 | A1 * | 12/2001 | Sullivan, Jr. | 124/84 |
| 2003/0041849 | A1 * | 3/2003 | Perry et al. | 124/84 |
| 2006/0191525 | A1 * | 8/2006 | Dai | 124/83 |
| 2007/0017498 | A1 * | 1/2007 | Finstad | 124/84 |
| 2007/0125351 | A1 * | 6/2007 | Campo et al. | 124/56 |
| 2008/0078370 | A1 * | 4/2008 | Kaakkola et al. | 124/73 |
| 2011/0000474 | A1 * | 1/2011 | Wood | 124/73 |
| 2011/0265777 | A1 * | 11/2011 | Wood | 124/84 |

* cited by examiner

BALLISTIC ADJUSTMENT DEVICE FOR TOY GUN

BACKGROUND OF THE PRESENT INVENTION

1. Field of Invention

The present invention relates to electric toy guns and more particularly, to ballistic adjustment device for use in a toy gun for adjustment of the ballistic range, which enhances bullet positioning stability and the stability of bullet ballistic trajectory.

2. Description of Related Arts

During operation of a conventional electric toy gun, a bullet (air-soft bullet) is fed into the rear end of the gun barrel and then driven out of the gun barrel. Due to the consideration of cost, the gun barrel of a toy gun does not provide a spiral line (rifling) on the inside wall thereof to guide the fired bullet along a spiral way. In consequence, the control of the bullet ballistic trajectory in a toy guy is difficult.

In view of the aforesaid problem, Taiwan Utility Patent Publication No. 299663 and Taiwan Utility Patent No. M298109 disclose the use of a ballistic adjustment device in a toy gun. However, these designs do not fit all different toy guns. For example, a big scale toy gun cannot use the aforesaid ballistic adjustment device directly. For use in a big scale toy gun, the aforesaid ballistic adjustment device must be modified.

FIG. 1 illustrates a ballistic adjustment device A0 for use in a big scale toy gun according to the prior art. According to this design, the ballistic adjustment device A0 is installed in the rear end of the toy gun's gun barrel 10, which has an end notch 101 (see FIG. 2). The ballistic adjustment device A0 comprises a bullet barrel 20, a pressure member 30 and a rotary control member 40 (see FIG. 2). Further, the ballistic adjustment device A0 is coupled to the gun barrel liner A02 by a coupling device A01 (see FIG. 1). The bullet barrel 20 is an elastic member (made of rubber or plastics) attached to the rear end of the gun barrel 10 (see FIG. 3), comprising a press portion 201 and an inside protruding block 202 (see FIG. 4) corresponding to the end notch 101 of the gun barrel 10, a rounded recess 203 located on the press portion 201, and an inside annular flange 204 (see FIG. 3). The inside protruding block 202 has a smoothly arched bottom recess. The pressure member 30 is a round ball accommodated in the rounded recess 203 of the bullet barrel 20. The rotary control member 40 is rotatably coupled to the rear end of the gun barrel 10 around the bullet barrel 20 and the pressure member 30, having an eccentric groove 401 located on the inside wall thereof (that has its one end made relatively deeper than its other end). The pressure member 30 is partially accommodated in the rounded recess 203 of the bullet barrel 20 and partially accommodated in the eccentric groove 401 of the rotary control member 40.

When rotating the rotary control member 40 relative to the gun barrel 10, the eccentric groove 401 is moved relative to the pressure member 30 to adjust the pressure at the pressure member 30, i.e. the elevation of the pressure member 30 is adjusted subject to rotation of the rotary control member 40 (see FIGS. 4 and 5). When the pressure member 30 is lowered, the inside protruding block 202 is relatively lowered. Before firing, a bullet 50 is fed into the bullet barrel 20 and stopped in position by the inside annular flange 204. When fired (see FIG. 6), the bullet 40 is forced over the inside annular flange 204, and rotated forwards subject to friction from the inside protruding block 202. Thus, adjusting the elevation of the inside protruding block 202 relatively adjust the ballistic trajectory.

However, this design of ballistic adjustment device still has drawbacks as follows:

1. The bullet 50 is a rounded member. When the inside protruding block 202 is lowered, the smoothly arched bottom recess of the inside protruding block 202 is elastically deformed into a substantially planar condition (see FIG. 5), reducing its contact area with the bullet 50. At this time, a gap exists between the bullet 50 and the bullet barrel 20. Thus, the bullet 50 may be not accurately kept in axial alignment with the axis of the gun barrel 10 affecting the stability of the ballistic trajectory.

2. If the bullet 50 is a defective member (not a perfect sphere, or having recessed and/or raised surface portions), friction between the inside protruding block 202 and the bullet 50 may cause a lateral pressure, affecting the moving angle of the ballistic trajectory.

3. The bullet barrel 20 is simply attached to the rear end of the gun barrel 10. When rotating the rotary control member 40, the bullet barrel 20 may be accidentally rotated relative to the gun barrel 10 by the rotary control member 40, lowering the accuracy of friction between the bullet 50 and the bullet barrel 20 and causing ballistic trajectory instability and a low hit-rate.

SUMMARY OF THE PRESENT INVENTION

The present invention has been accomplished under the circumstances in view. It is one object of the present invention to provide a ballistic adjustment device for toy gun, which facilitates adjustment of the ballistic trajectory, keeps the bullet in balance for firing, and enhances bullet positioning stability and the stability of the bullet ballistic trajectory.

To achieve this and other objects of the present invention, a ballistic adjustment device is installed in the rear end of the gun barrel of a toy gun. The gun barrel comprises an end notch at the rear end thereof, and a locating groove extending around the periphery thereof and disposed adjacent to the end notch. The ballistic adjustment device comprises a bullet barrel, a pressure member and a rotary control member. The bullet barrel is made of a flexible material and attached to the rear end of the gun barrel, comprising a bearing portion located on the top side thereof. The pressure member is adapted to impart a pressure to bullet to be fired. The rotary control member surrounds the bullet barrel and the pressure member, comprising an eccentric groove located on an inside wall thereof and accommodating a part of the pressure member. The rotary control member is rotatable relative to the bullet barrel to adjust the relative position between the eccentric groove and the accommodated part of the pressure member. Further, the bullet barrel comprises two inside protruding portions downwardly extended from an inside wall of said bearing portion and projecting into the end notch of the gun barrel. Further, a positioning member is press-fitted onto the bullet barrel and fastened to the rear end of the gun barrel. The positioning member comprises an opening corresponding to the bearing portion of the bullet barrel and the end notch of the gun barrel.

Further, the pressure member is a resilient member comprising an open ring base attached to the locating groove of the gun barrel and a spring arm extended from the open ring base and terminating in a downwardly curved press portion and upwardly protruding positioning tip. The downwardly curved press portion projects into the opening of the positioning member and pressed on the bearing portion of the bullet barrel. The upwardly protruding positioning tip is accommodated in the eccentric groove of the rotary control member.

Further, the positioning member comprises a recessed portion disposed near the front side of the opening. The spring arm in front of the downwardly curved press portion is positioned in the recessed portion of the positioning member.

Further, the positioning member is fastened to the rear end of the gun barrel at the rear side relative to the locating groove of the gun barrel. The open ring base of the pressure member is stopped against the front side of the positioning member.

Further, the inside protruding portions of the bullet barrel are smoothly arched.

DETAILED DESCRIPTION OF THE PREFERRED EMBODIMENT

Figure 1:
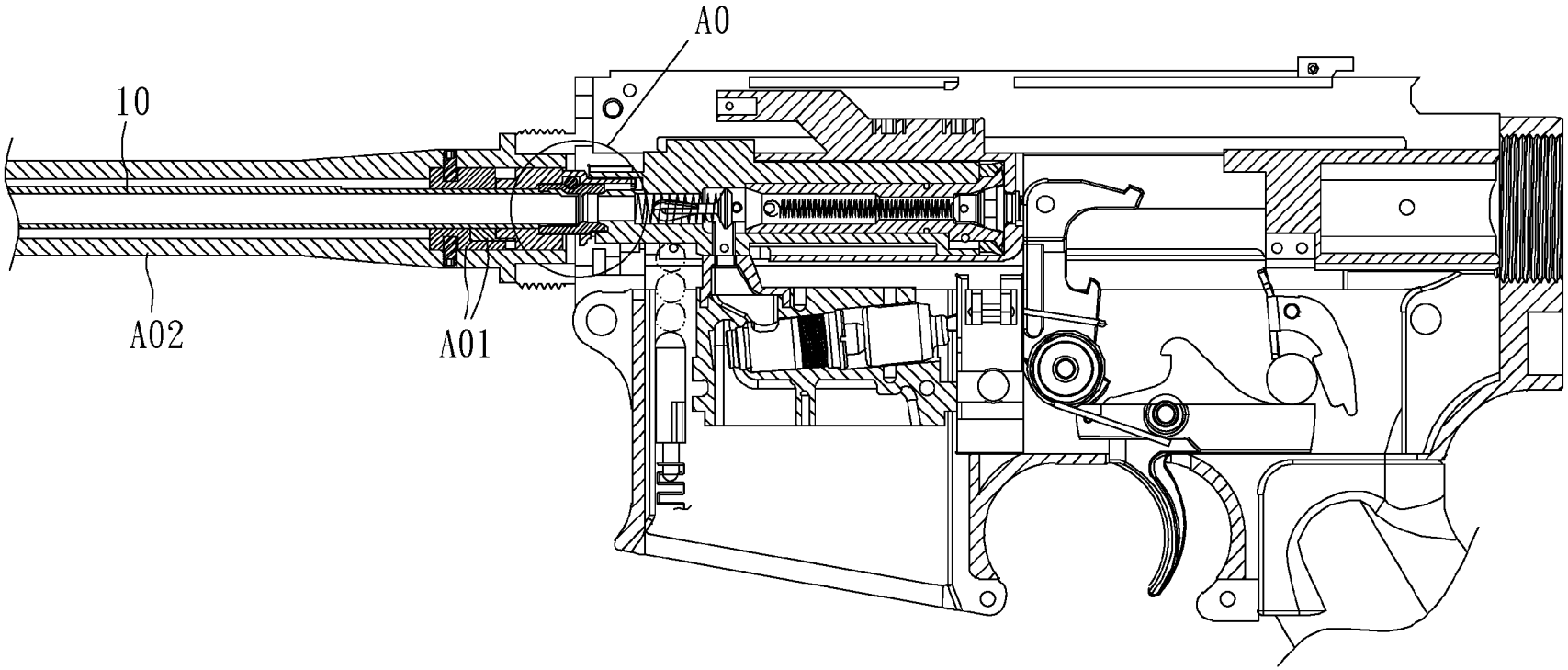
FIG. 1(PRIOR ART)
FIG. 1 is a schematic sectional side view illustrating the arrangement of a ballistic adjustment device in an electric toy gun according to the prior art.
Figure 2:
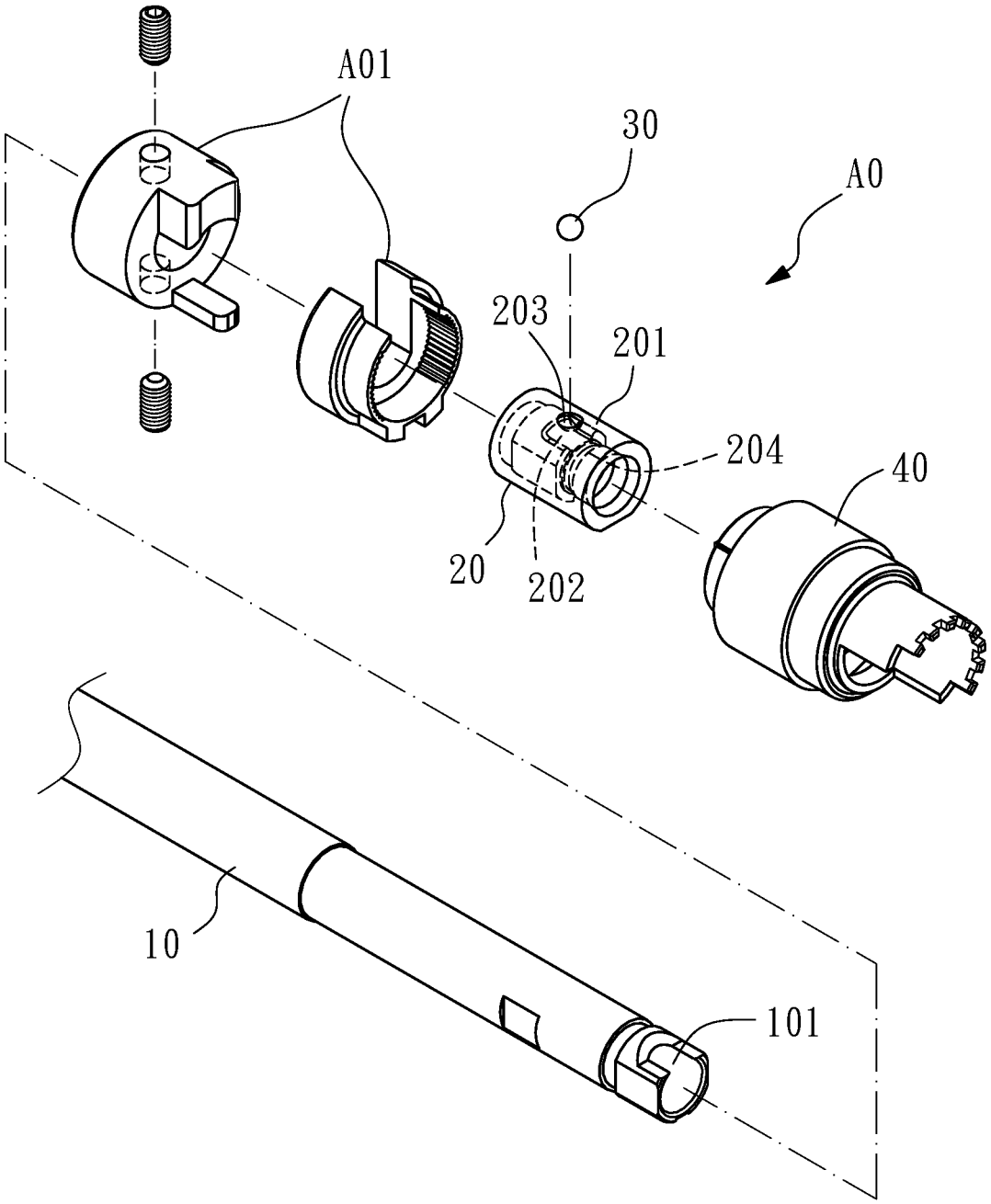
FIG. 2(PRIOR ART)
FIG. 2 is an exploded view of the ballistic adjustment device according to the prior art.
Figure 3:
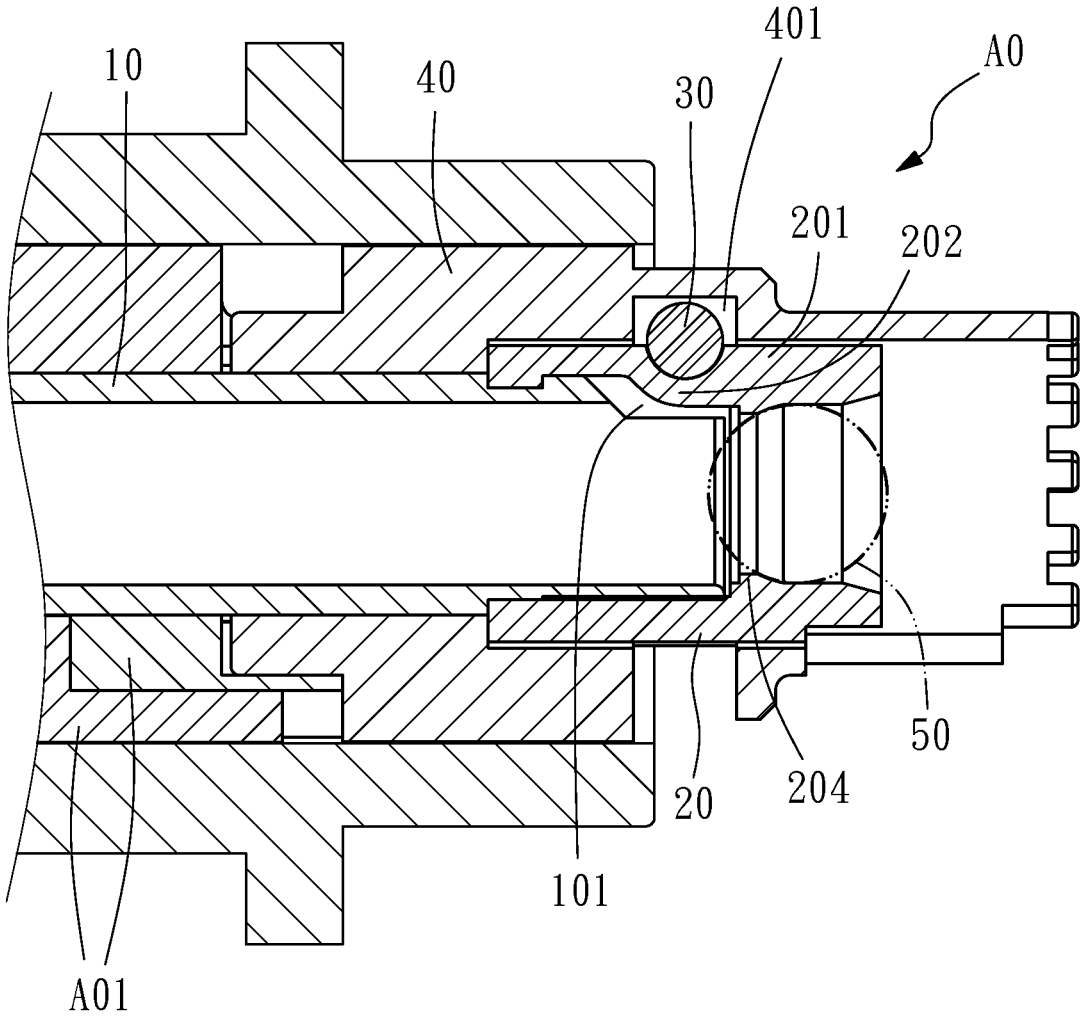
FIG. 3(PRIOR ART)
FIG. 3 is a sectional plain assembly view of the ballistic adjustment device according to the prior art.
Figure 4:
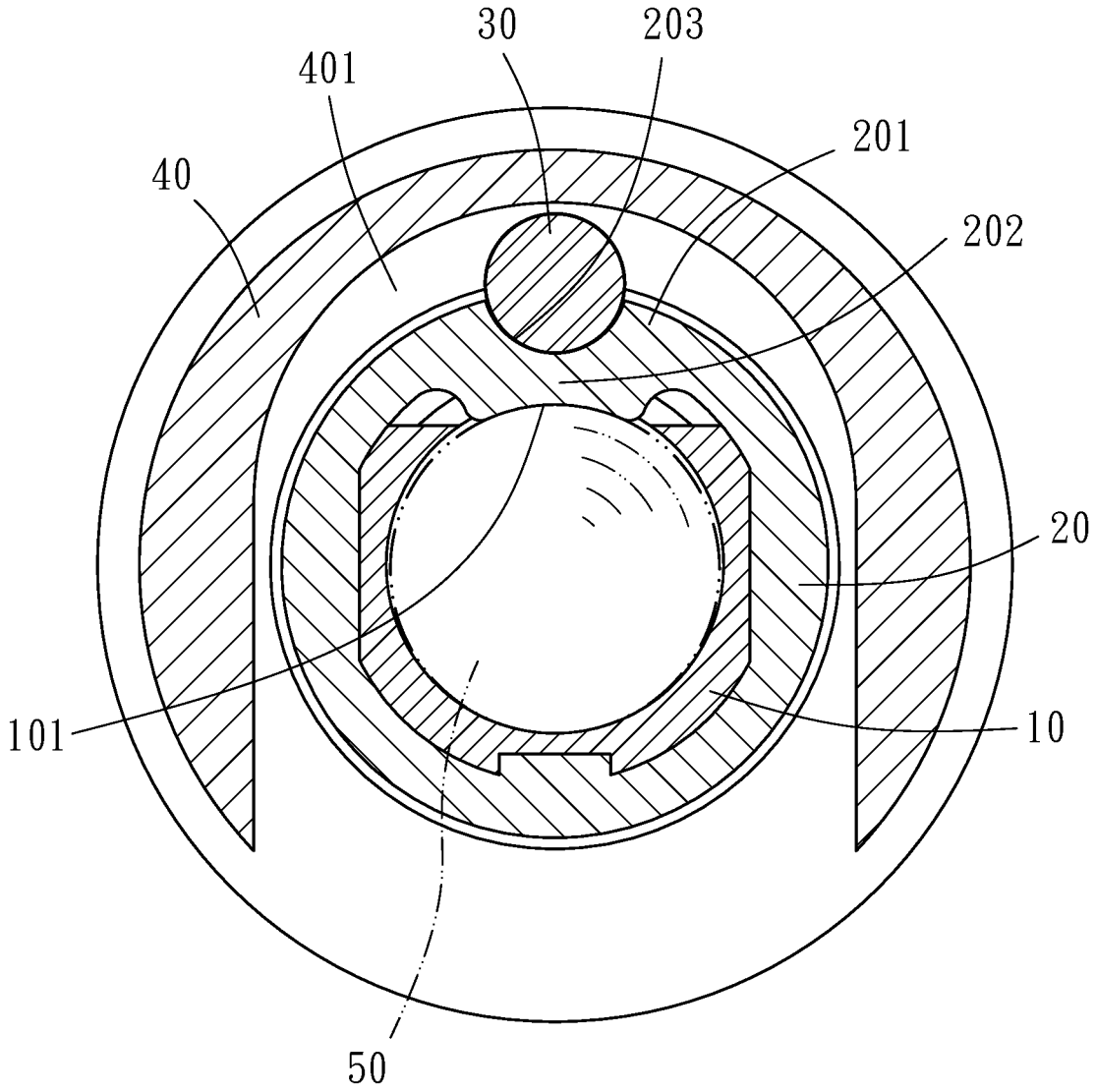
FIG. 4(PRIOR ART)
FIG. 4 is a cross sectional view of FIG. 3.
Figure 5:
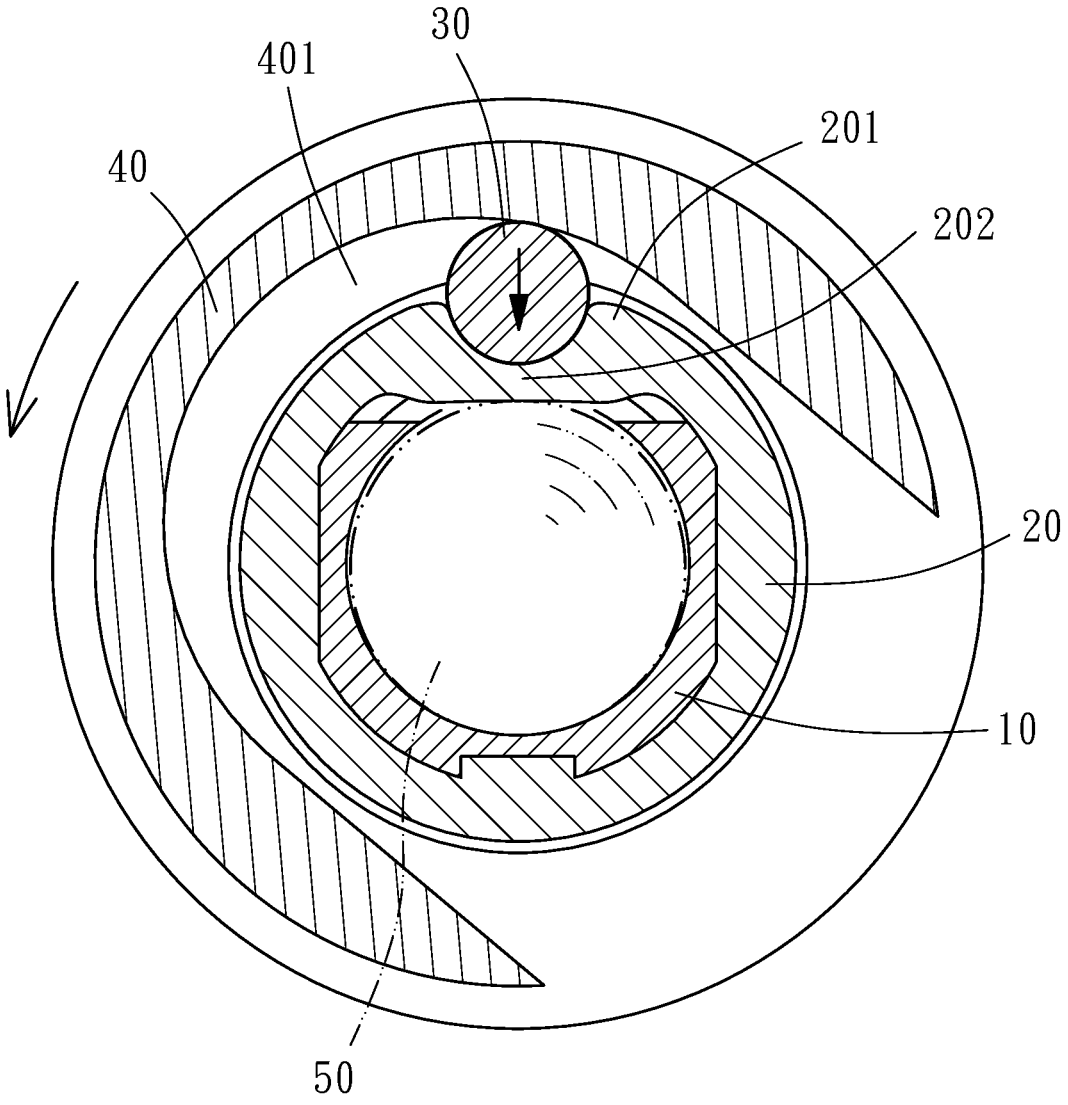
FIG. 5(PRIOR ART)
FIG. 5 corresponds to FIG. 4, illustrating the rotary member rotated.
Figure 6:
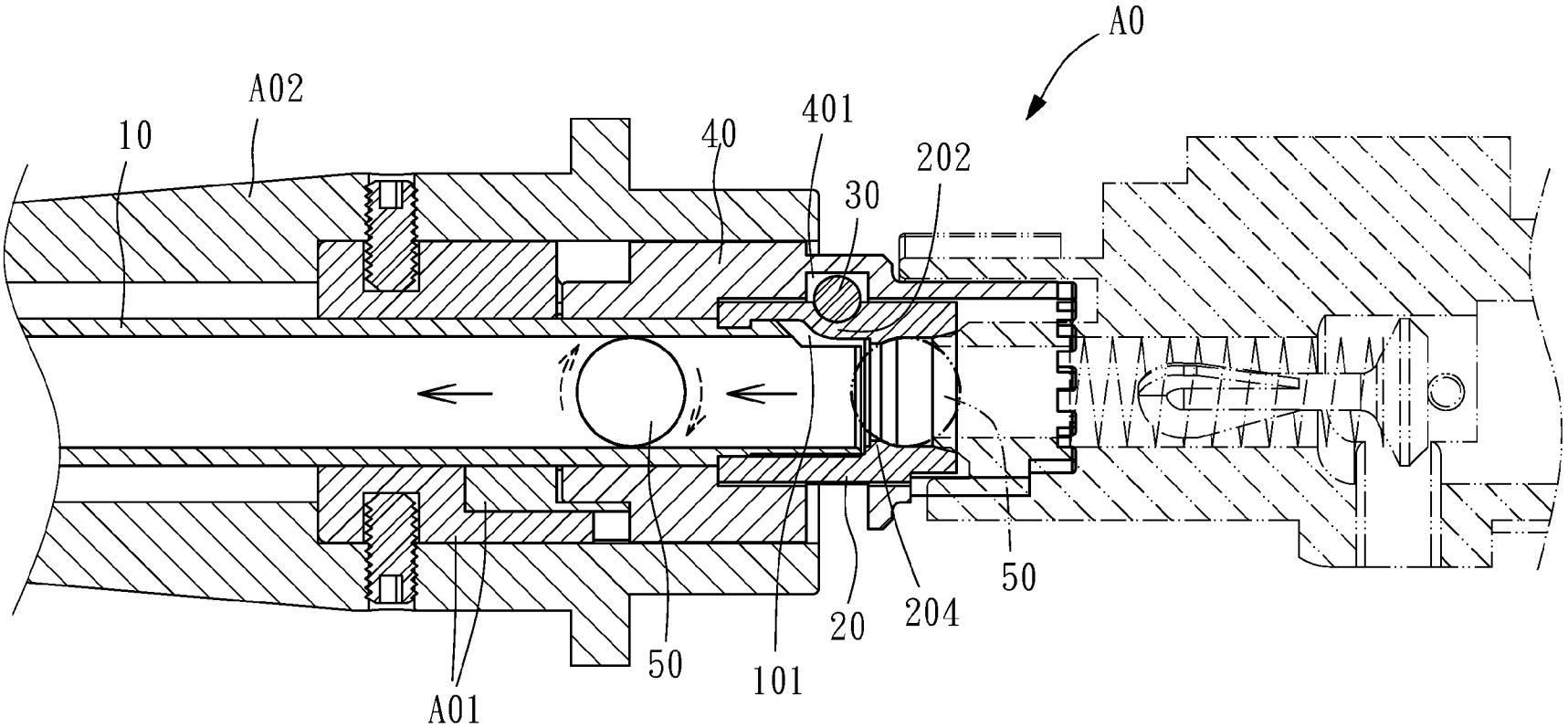
FIG. 6(PRIOR ART)
FIG. 6 is a schematic drawing illustrating an operation status of the ballistic adjustment device in the electric toy gun according to the prior art.
Figure 7:
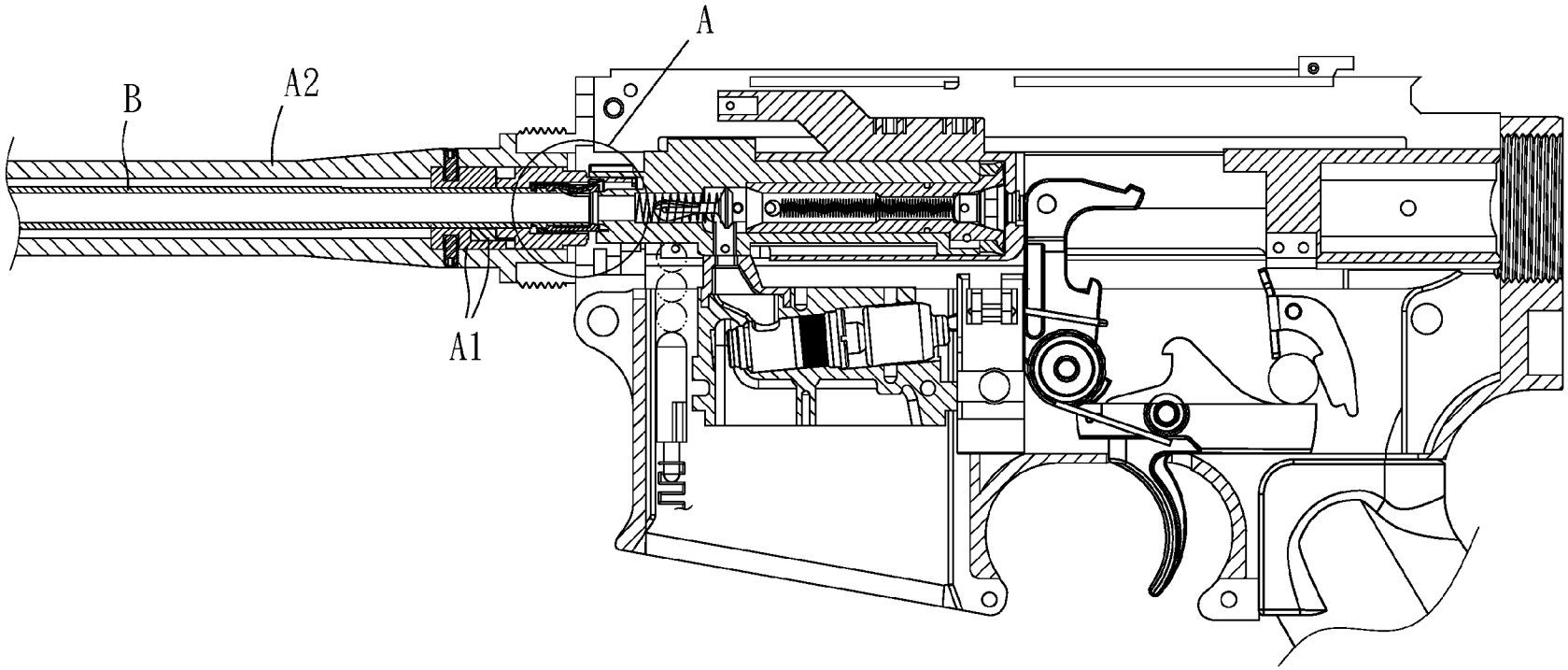
FIG. 7 is a schematic sectional side view illustrating the arrangement of a ballistic adjustment device in an electric toy gun according to the present invention.

Referring to FIG. 7, a ballistic adjustment device A is shown installed in the rear end of the gun barrel B of a toy gun. The gun barrel B has an end notch B1 at the rear end thereof, and a locating groove B2 extending around the periphery and disposed adjacent to the end notch B1.

Figure 8:
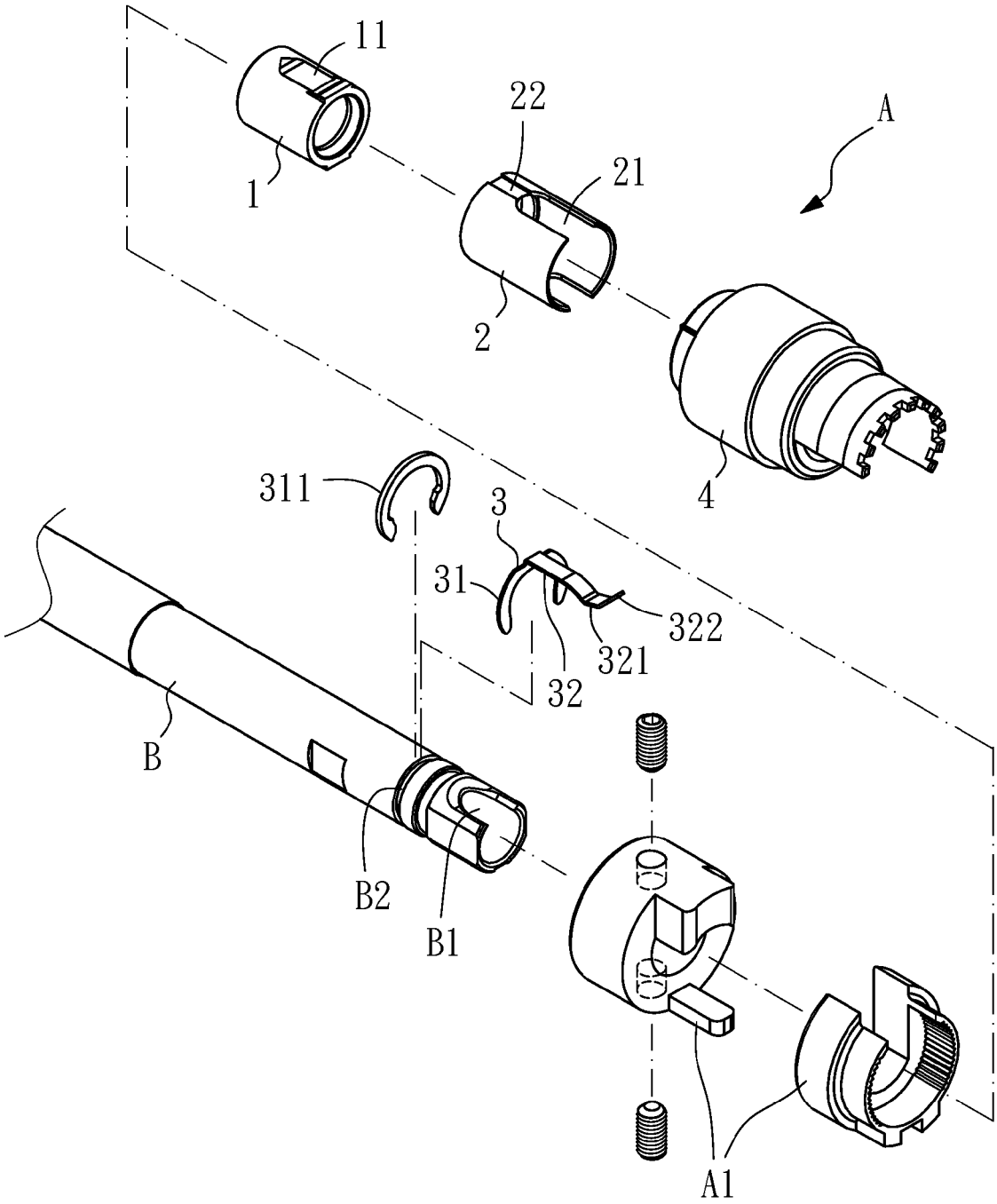
FIG. 8 is an exploded view of the ballistic adjustment device according to the present invention.
Figure 9:
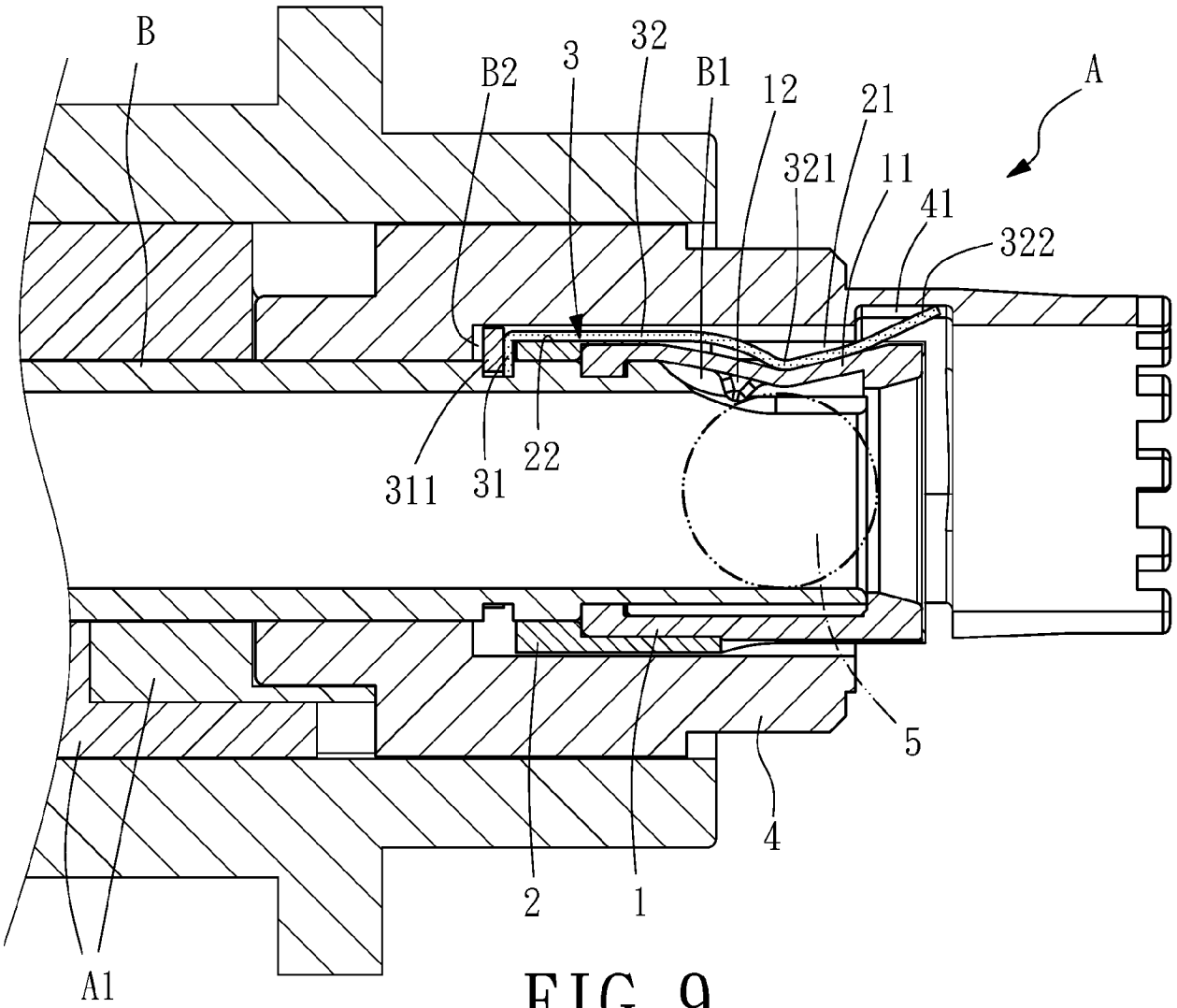
FIG. 9 is a sectional plain assembly view of the ballistic adjustment device according to the present invention.

Referring to FIGS. 8 and 9 and FIG. 7 again, the ballistic adjustment device A comprises a bullet barrel 1, a positioning member 2, a pressure member 3 and a rotary control member 4 (see FIGS. 8 and 9). Further, the ballistic adjustment device A is coupled to the gun barrel liner, referenced by A2, by a coupling device A1 (see FIG. 7).

Figure 10:
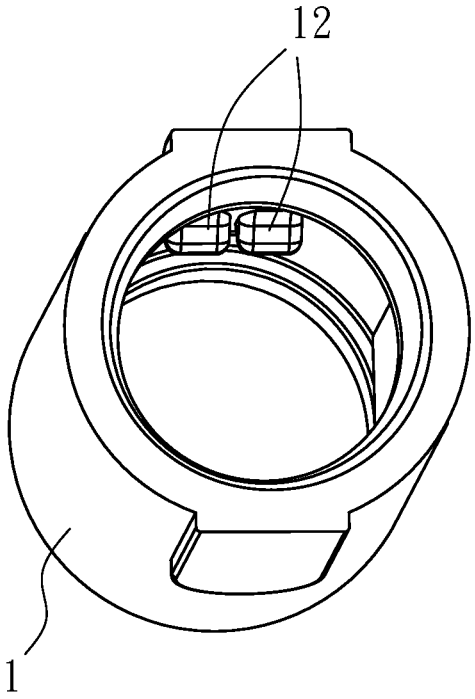
FIG. 10 is an oblique elevational view of the bullet barrel of the ballistic adjustment device according to the present invention.

The bullet barrel 1 (see FIG. 8) is made of a flexible material (for example, rubber or plastics) and attached to the rear end of the gun barrel B (see FIG. 9), comprising a bearing portion 11 located on the top side thereof and two inside protruding portions 12 located on the inside wall thereof corresponding to the bearing portion 11. The inside protruding portions 12 are smoothly arched (see FIG. 10).

Figure 11:
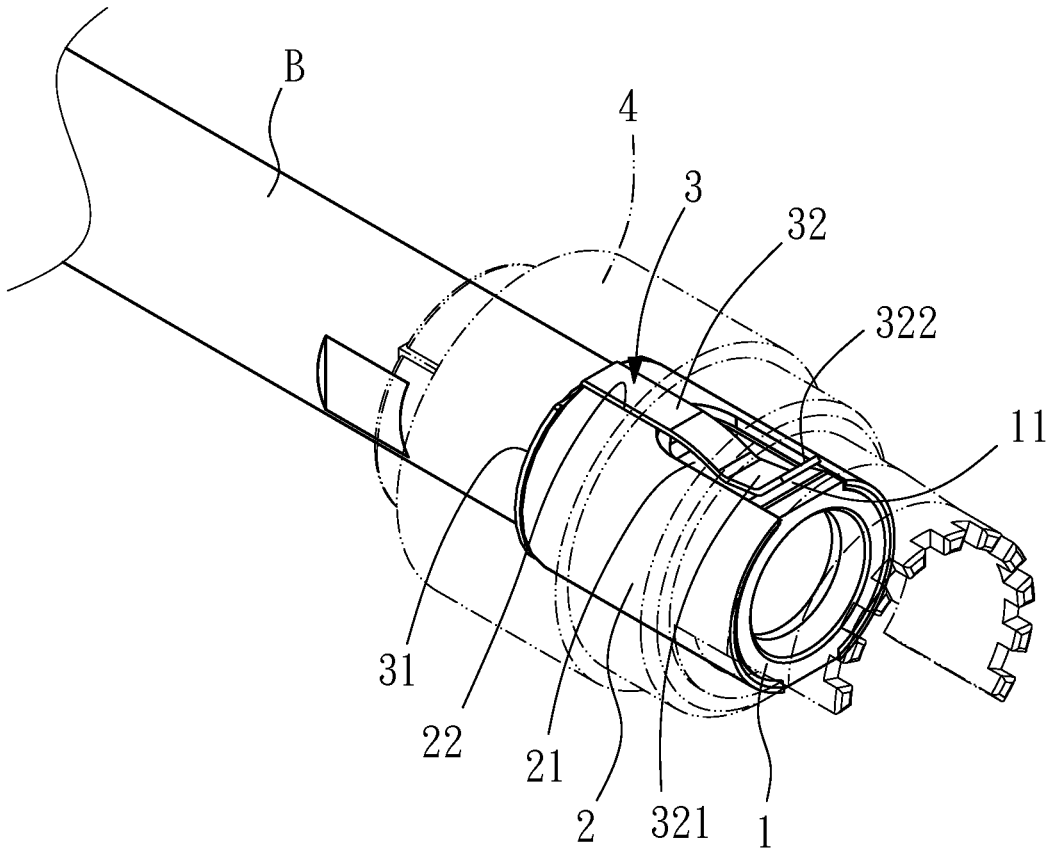
FIG. 11 is a perspective view of the present invention, illustrating the bullet barrel, the positioning member and the pressure member held in the rotary control member at the rear end of the gun barrel.

The positioning member 2 (see FIG. 9) is made of metal (for example, ferrite, aluminum or copper) and press-fitted onto the bullet barrel 1 and fastened to the rear end of the gun barrel B at the rear side relative to the locating groove B2, comprising an opening 21 corresponding to the bearing portion 11 of the bullet barrel 1 (see FIG. 11) and a recessed portion 22 disposed at the front side of the opening 21 (see FIG. 8).

The pressure member 3 (see FIG. 8) is a resilient member made of, for example, copper, comprising an open ring base 31 attached to the locating groove B2 of the gun barrel B and abutted against the front side of the positioning member 2 and secured thereto by a clamp 311 (see FIG. 9) and a spring arm 32 extended from the open ring base 31 and terminating in a downwardly curved press portion 321 and upwardly protruding positioning tip 322. The downwardly curved press portion 321 projects into the opening 21 of the positioning member 2 and pressed on the bearing portion 11 of the bullet barrel 1. The spring arm 32 in front of the downwardly curved press portion 321 is positioned in the recessed portion 22 of the positioning member 2.

Figure 12:
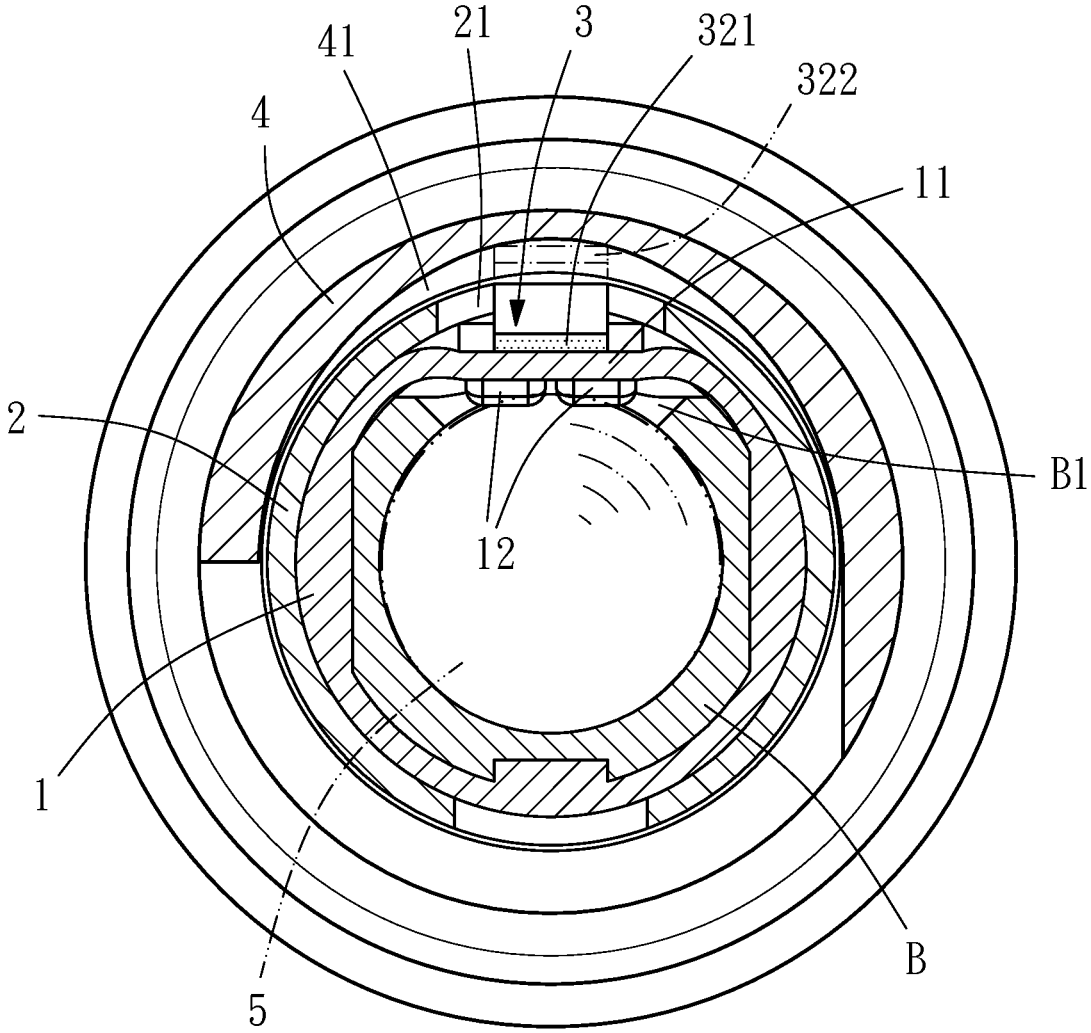
FIG. 12 is a cross-sectional view of FIG. 9.
Figure 13:
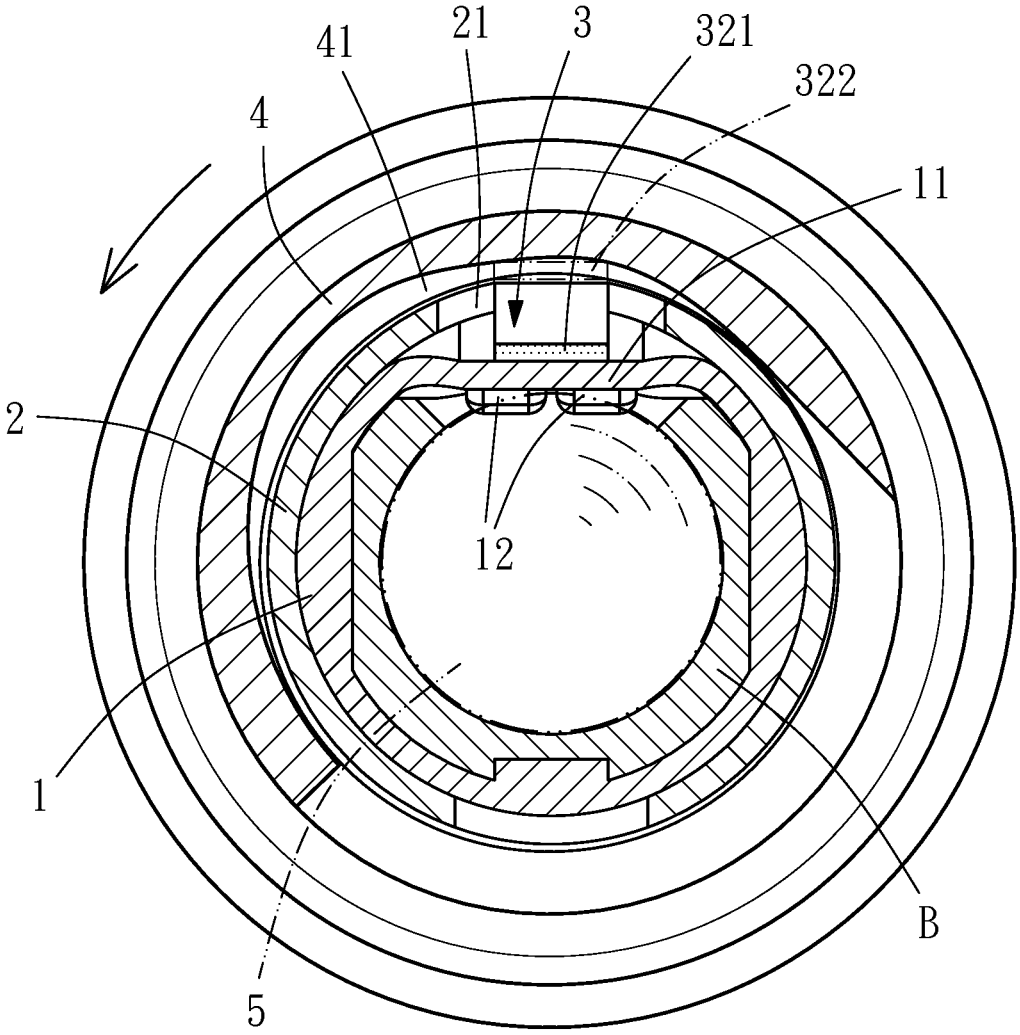
FIG. 13 corresponds to FIG. 12, illustrating the rotary control member rotated relative to the bullet barrel and the positioning member.
Figure 14:
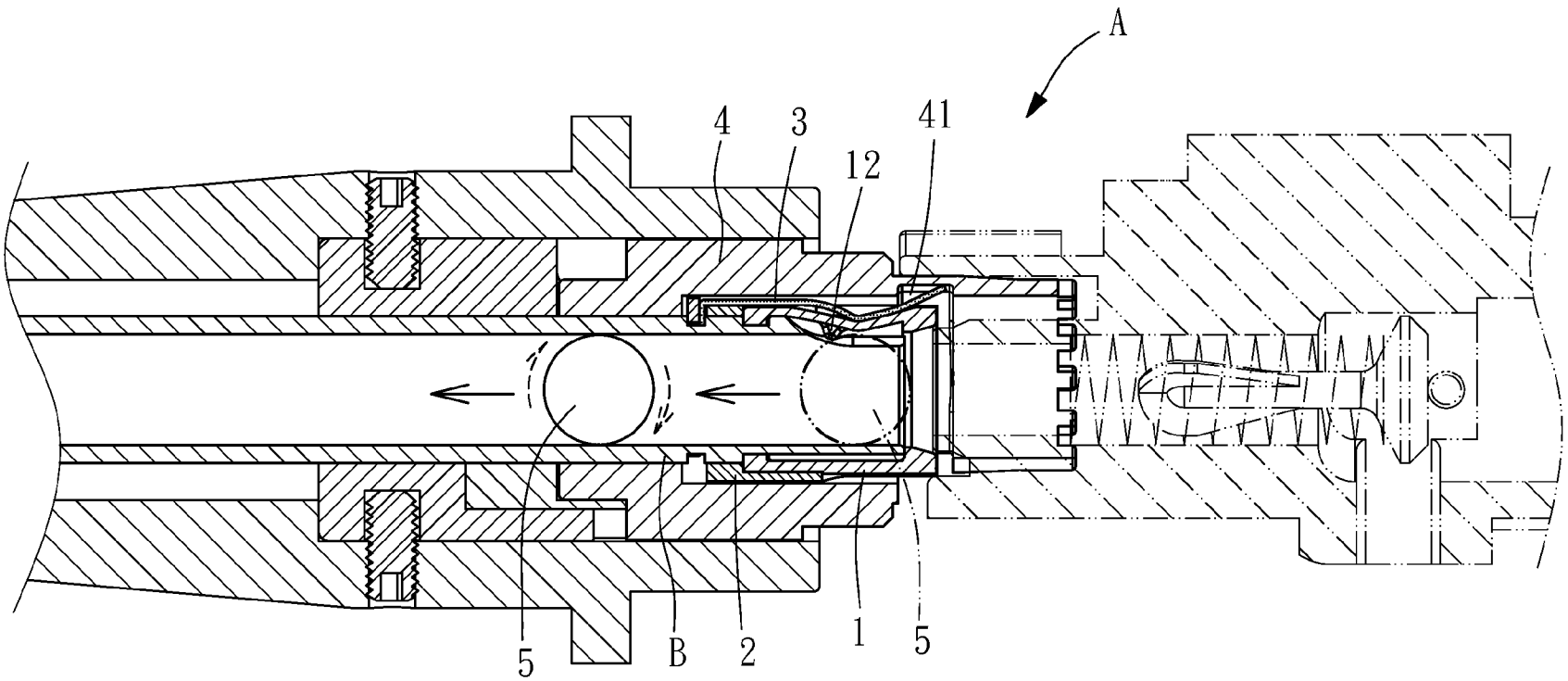
FIG. 14 is a schematic sectional view of the present invention, illustrating a toy bullet firing action.

The rotary control member 4 (see FIG. 9) is sleeved onto the bullet barrel 1 and the positioning member 2 and surrounding the pressure member 3, having an eccentric groove 41 (that has its one end made relatively deeper than its other end). The upwardly protruding positioning tip 322 is positioned in between the eccentric groove 41 of the rotary control member 4 and the opening 21 of the positioning member 2. When rotating the rotary control member 4 in one direction, the shadow end of the eccentric groove 41 is forced against the upwardly protruding positioning tip 322 to impart a downward pressure to the bearing portion 11 of the bullet barrel 1 via the downwardly curved press portion 321 (see FIG. 13). On the contrary, when rotating the rotary control member 4 in the reversed direction, the deep end of the eccentric groove 41 is moved to the upwardly protruding positioning tip 322, and therefore the downwardly curved press portion 321 is released from the bearing portion 11 of the bullet barrel 1 (see FIG. 12).

After installation of the ballistic adjustment device A in the gun barrel B of the toy gun, the bullet barrel 1 is firmly secured to the rear end of the gun barrel B by the positioning member 2 and prohibited from rotation relative to the gun barrel B. Before firing, a toy bullet 5 is fed into the bullet barrel 1 and the rear end of the gun barrel B (see FIG. 9). At this time, the toy bullet 5 is held in position by the two inside protruding portions 12 of the bullet barrel 1 (see FIG. 12). When going to adjust the ballistic range, rotate the rotary control member 4 to force the eccentric groove 41 against the upwardly protruding positioning tip 322 in causing the downwardly curved press portion 321 to impart a downward pressure to the bearing portion 11 of the bullet barrel 1 (see FIG. 13), and at the time, the two inside protruding portions 12 of the bullet barrel 1 are lowered to increase the applied pressure to the toy bullet 5. When rotating the rotary control member 4 in the reversed direction, the applied pressure is relatively reduced. After the toy bullet 5 is being fired, the bottom edge of each of the two inside protruding portions 12 touches a tangent plane of the toy bullet 5, and the toy bullet 5 is spirally rotated and driven out of the gun barrel B of the toy gun to surpass the gravitational attraction, and therefore the toy bullet 5 goes steadily forwards along a predetermined ballistic trajectory. By means of rotating the rotary control member 4 to adjust the elevation of the inside protruding portions 12, the tangent contact point between the inside protruding portions 12 and the toy bullet 5 to be fired is relatively changed, and therefore the rotary inertia of the toy bullet 5, i.e., the ballistic trajectory is relatively adjusted.

As stated above, when one toy bullet 5 is fed into the bullet barrel 1 and the rear end of the gun barrel B, the toy bullet 5 is held in position by the inside protruding portions 12 of the bullet barrel 1. Even if the toy bullet 5 is a defective toy bullet, it can still be kept in balance in the rear end of the gun barrel B by the inside protruding portions 12 of the bullet barrel 1, avoiding any lateral pressure and assuring firing accuracy and ballistic trajectory stability. Further, the positioning member 2 holds down the bullet barrel 1 positively in position, preventing displacement of the bullet barrel 1 during rotation of the rotary control member 4.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A ballistic adjustment device installed in a rear end of a gun barrel of a toy gun, said gun barrel comprising an end notch at the rear end thereof and a locating groove extending around the periphery thereof and disposed adjacent to said end notch, the ballistic adjustment device comprises a bullet barrel made of a flexible material and attached to the rear end of said gun barrel, said bullet barrel comprising a bearing portion located on the top side thereof, a pressure member supported on said bearing portion of said bullet barrel, and a rotary control member surrounding said bullet barrel and said pressure member, said rotary control member comprising an eccentric groove located on an inside wall thereof and accommodating a part of said pressure member, said rotary control member being rotatable relative to said bullet barrel to adjust the relative position between said eccentric groove and the accommodated part of said pressure member, wherein: said bullet barrel comprises two inside protruding portions downwardly extended from an inside wall of said bearing portion and projecting into said end notch of said gun barrel; a positioning member is press-fitted onto said bullet barrel and fastened to the rear end of said gun barrel, said positioning member comprising an opening corresponding to said bearing portion of said bullet barrel and said end notch of said gun barrel.

2. The ballistic adjustment device as claimed in claim 1, wherein said pressure member is a resilient member comprising an open ring base attached to said locating groove of said gun barrel and a spring arm extended from said open ring base and terminating in a downwardly curved press portion and upwardly protruding positioning tip, said downwardly curved press portion projecting into said opening of said positioning member and pressed on said bearing portion of said bullet barrel, said upwardly protruding positioning tip being accommodated in said eccentric groove of said rotary control member.

3. The ballistic adjustment device as claimed in claim 2, wherein said positioning member comprises a recessed portion disposed near a front side of said opening; said spring arm in front of said downwardly curved press portion of said pressure member is positioned in said recessed portion of said positioning member.

4. The ballistic adjustment device as claimed in claim 3, wherein said positioning member is fastened to the rear end of said gun barrel at a rear side relative to said locating groove of said gun barrel; said open ring base of said pressure member is stopped against a front side of said positioning member.

5. The ballistic adjustment device as claimed in claim 4, wherein said inside protruding portions of said bullet barrel are smoothly arched.

* * * * *